US005100536A

United States Patent [19]

Bönisch et al.

[11] Patent Number: 5,100,536

[45] Date of Patent: Mar. 31, 1992

[54] METHOD OF PROCESSING SUBSTANCES

[75] Inventors: Ulrich Bönisch, Mülheim/Ruhr; Claus Strecker, Gelsenkirchen; Wolfdieter Klein, Recklinghausen, all of Fed. Rep. of Germany

[73] Assignee: Ruhrkohle AG, Essen, Fed. Rep. of Germany

[21] Appl. No.: 516,613

[22] Filed: Apr. 30, 1990

[30] Foreign Application Priority Data

Apr. 28, 1989 [DE] Fed. Rep. of Germany ..... 3914057

[51] Int. Cl.[5] ..... C10G 7/00

[52] U.S. Cl. ..... 208/408; 208/400; 208/142; 208/43; 208/150; 208/95; 208/97; 208/356; 208/362; 203/49

[58] Field of Search ..... 203/49; 208/400, 142, 208/107, 43, 150, 408, 95, 97, 356, 362; 210/774

[56] References Cited

U.S. PATENT DOCUMENTS

| | | | |
|---|---|---|---|
| 1,940,648 | 12/1933 | Russell | 208/400 |
| 4,216,077 | 8/1980 | Chahrekilian et al. | 208/107 |
| 4,465,584 | 8/1984 | Effron et al. | 208/362 |
| 4,822,480 | 4/1989 | Harandi et al. | 208/356 |

*Primary Examiner*—Stanley S. Silverman
*Assistant Examiner*—Neil M. McCarthy
*Attorney, Agent, or Firm*—Nils H. Ljungman & Associates

[57] ABSTRACT

A method of processing hydrocarbon substances including coal, heavy crude oil, and bitumen by hydrogenating the hydrocarbon substance with a gas containing from 20%-100% hydrogen at a pressure in the range of from 50 bar to 700 bar and at a temperature in the range of from 250° C. to 600° C. to produce a hydrogenation residue which is treated in a secondary stripping operation using hydrogen gas at a pressure between about 1.2 bar and 150 bar to recover light hydrocarbon gases from the hydrogenation residue.

5 Claims, 3 Drawing Sheets

EXPERIMENTAL ASSEMBLY

PROCESSING PLANT

METHOD OF PROCESSING SUBSTANCES

BACKGROUND OF THE INVENTION

1. Field of the Invention:

This invention relates to a process for the processing of coal, heavy crude oil, bitumen or the like by heating the substances at specified temperatures and under specified pressures, followed by precipitation of hot sludge, whereby the hot sludge is further processed by stripping with gas.

2. Background Information:

Liquid hydrocarbons are separated on the basis of process-specific and product-specific conditions into products with different boiling ranges, such as gas, liquefied petroleum gas, gasoline, medium crude oil, heavy crude oil and residue by distillation. The bottom products of the distillation, so-called residues, are either converted to light products and separated as described above into product and residues, or used as fuel, such as heavy fuel oil and processed into bitumen.

In the prior art, the residues are distilled in vacuum plants at approximately 400° C.–450° C. and at 20 mbar–10 mbar. This process is the conventional one used in most refineries.

Extraction offers another possibility for separating hydrocarbons since the different solubility characteristics of liquids may be taken advantage of. The extraction agent dissolves the extract from a mixture of substances. The extraction agent is regenerated by the separation of the extract and injected in a process circuit. The separation can also take place by means of extraction or by means of distillation.

The prior art discloses supercritical extraction by means of processes for separation of paraffinic and aromatic hydrocarbons and hydrocarbon groups of asphalts. The extraction agents used are primarily components in the supercritical stage and, therefore, the partial pressures for mixtures must exceed certain specified critical values of temperature and pressure.

As an example, the critical values of several hydrocarbons are shown in the following table:

| | Critical Temp. °C. | Critical Pressure |
|---|---|---|
| $H_2$ | −240 | 13 |
| Methane | −82 | 46 |
| Ethane | 35 | 49 |
| Propane | 97 | 42 |
| n-Butane | 152 | 34 |

The processes of the prior art exhibit significant disadvantages in practical applications. For example, some of the disadvantages inherent in the use of vacuum distillation plants are that:

1. The production of a vacuum requires a significant use of steam, and entails waste water problems.

2. The vacuum causes safety problems if there are leaks in the system causing possible oxygen infiltration and a danger of explosion.

3. As a result of the high temperature under which the process is conducted, coking problems may occur on account of unsaturated hydrocarbons, which on one hand have an effect on the product quality and on the other hand lead to operational problems. As a rule therefore, a maximum temperature of 450° C. cannot be exceeded.

4. On account of the high-viscosity bottom products produced, there are discharge problems due to the lack of the required net positive suction head (NPSH) value on the extraction pump.

5. On account of the high velocities at the input (approximately 120 m/s), wear problems occur in valves and in the process column. Therefore, the systems may, eventually, require reinforcement.

6. Because of the employment of a vacuum and on account of the low vapor densities, large sized equipment, resulting in high investment costs, must be employed to limit the vapor velocity to technically acceptable values and to insure acceptable values of fluid discharge and pressure loss.

The disadvantages of the extraction process are that:

1. With these processes, substance-specific characteristics must be taken into consideration and, therefore, a special extraction agent must be found for each extract since no universal extraction agent exists.

2. The regeneration of the extraction agent is substance-specific and equipment-intensive. Regeneration can be performed by extraction, distillation and pressure change, combined with temperature changes.

3. On account of the expense of regeneration, there is a significant equipment expense and associated high investment cost.

4. On account of solubility equilibriums, there is always an extraction agent loss, which can lead to high operating costs.

The above-mentioned disadvantages of vacuum and extraction facilities can be reduced or even substantially, if not completely, eliminated by the use of the present invention.

German Laid Open Patent Application No. 31 23 535 discloses that separation of desired components can be done by stripping with gas. The change of partial pressure of the vapors necessary for product separation is achieved by the vacuum produced.

OBJECT OF THE INVENTION

An object of the present invention is, therefore, to provide an improved process for the separation of components.

SUMMARY OF THE INVENTION

This object of the invention is achieved in that the required partial pressure change of the vapors to separate the products is produced by the gas used to separate components. The heat of vaporization may be the same as the input temperature of the fluid and/or the input temperature of the gas. The separation advantageously takes place with a reduction of temperature at constant pressure.

One aspect of the invention resides broadly in a method of processing a substance comprising the steps of: providing a substance to be processed, providing a gas for processing the substance, pressurizing the substance and the gas together at a preselected pressure, heating the substance and the gas to a preselected temperature and processing the substance into a first component and a second component.

BRIEF DESCRIPTION OF THE DRAWINGS

The following Description of the Preferred Embodiments may be better understood when taken in conjunction with the appended drawings in which.

DESCRIPTION OF THE PREFERRED EMBODIMENTS

Figure 1:
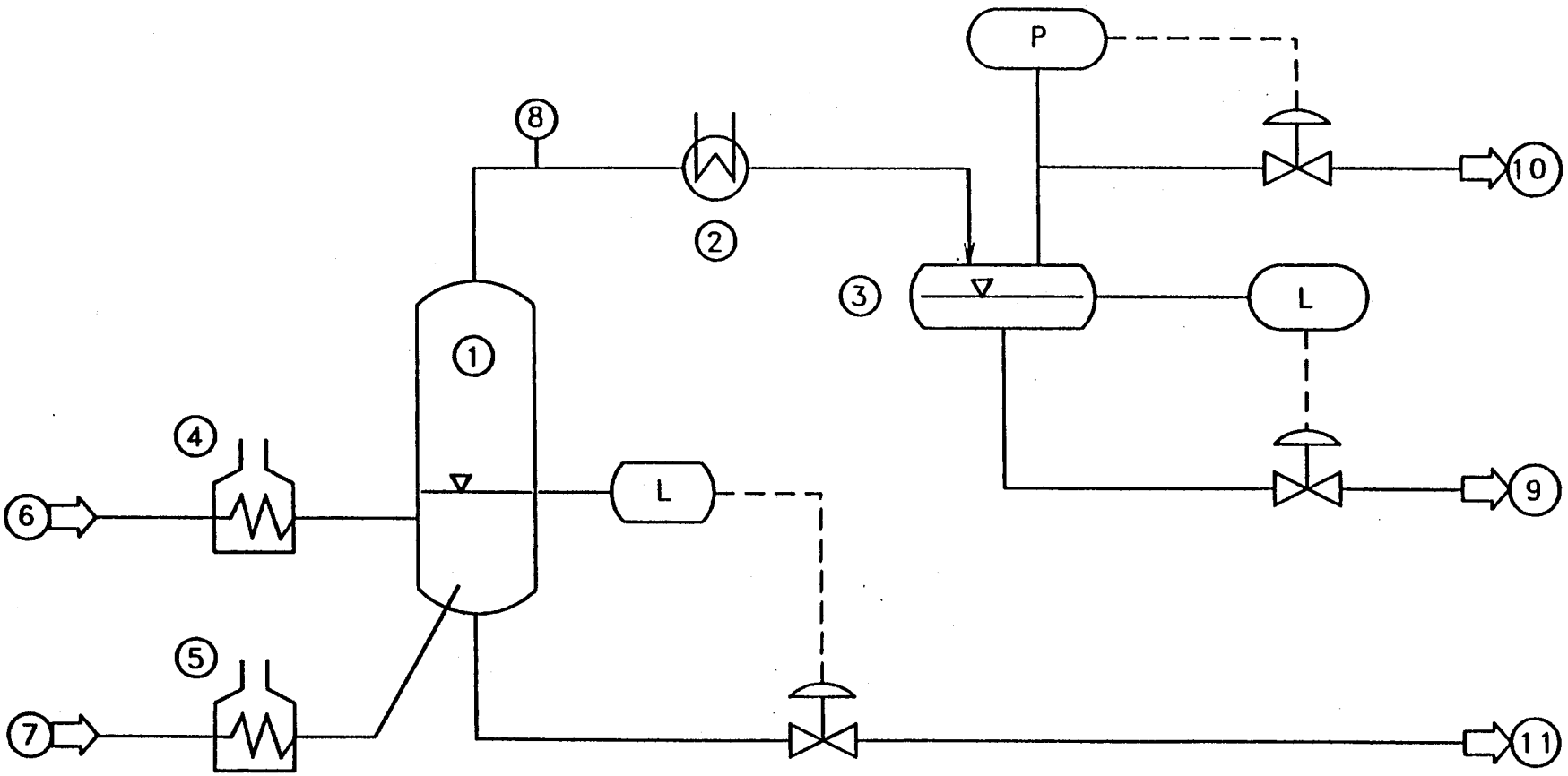
FIG. 1 is a schematic diagram of a process employing the present invention.

As shown in FIG. 1, stripper vessel 1 is adapted to receive hydrocarbon material 6 and stripping gas 7, which have been preheated in heaters 4 and 5, respectively. Material 6 and gas 7 are mixed and the components of material 6 to be separated are stripped as the product. These components then travel with the gas through conduit 8 from the top of vessel 1 and are condensed out in condenser 2. Gas is separated from the product in separator 3. The product exits separator 3 through valved conduit 9. The gases travel through the top of separator 3 through valved conduit 10.

The residue exits stripper tank 1 through valved conduit 11. The process operates in the temperature range between 250° C. and 600° C. and in the pressure range between 1.2 bar and 150 bar.

The gas used can be any refinery gas, natural gas or city gas and is, preferably, gas containing a level of hydrogen of between 20%–100% by volume. The gas used may be hydrogen which, necessarily, is produced as a waste gas in refineries and petrochemical plants.

The advantages of this process, compared to vacuum plants, are that:

1. There are no waste water problems, since steam radiators are eliminated.

2. There are no safety problems caused by oxygen intrusion, since the process operates with overpressure.

3. The temperature limitation of approximately 450° C. is eliminated, and there are no coking problems, since hydrogen, for saturation of the unsaturated components, is readily available.

4. The extraction of the bottom products does not pose a problem since sufficient pressure exists in the vessel for a controlled discharge. Even substances with viscosities up to approximately 3.000 m Pa s can be discharged easily. In terms of other units, 1 m Pa s=1 centipoise and 1 poise=0.1 Pa s. In vacuum columns, the discharge fails at a viscosity of approximately 800 m Pa s as a result of the design of the suction pump.

5. Wear problems caused by high velocity do not occur.

6. The equipment sizes are small since the process pressure is greater than 1.2 bar and, therefore, significant investment costs can be saved.

7. The above-mentioned disadvantages of the extraction process are eliminated altogether, since the present invention does not use the change of the fluid/fluid equilibrium but, instead, uses the gas/vapor-fluid equilibrium.

8. Overall, the cost of equipment and machinery is significantly reduced.

The following is an example of a test of the present invention.

Figure 2:
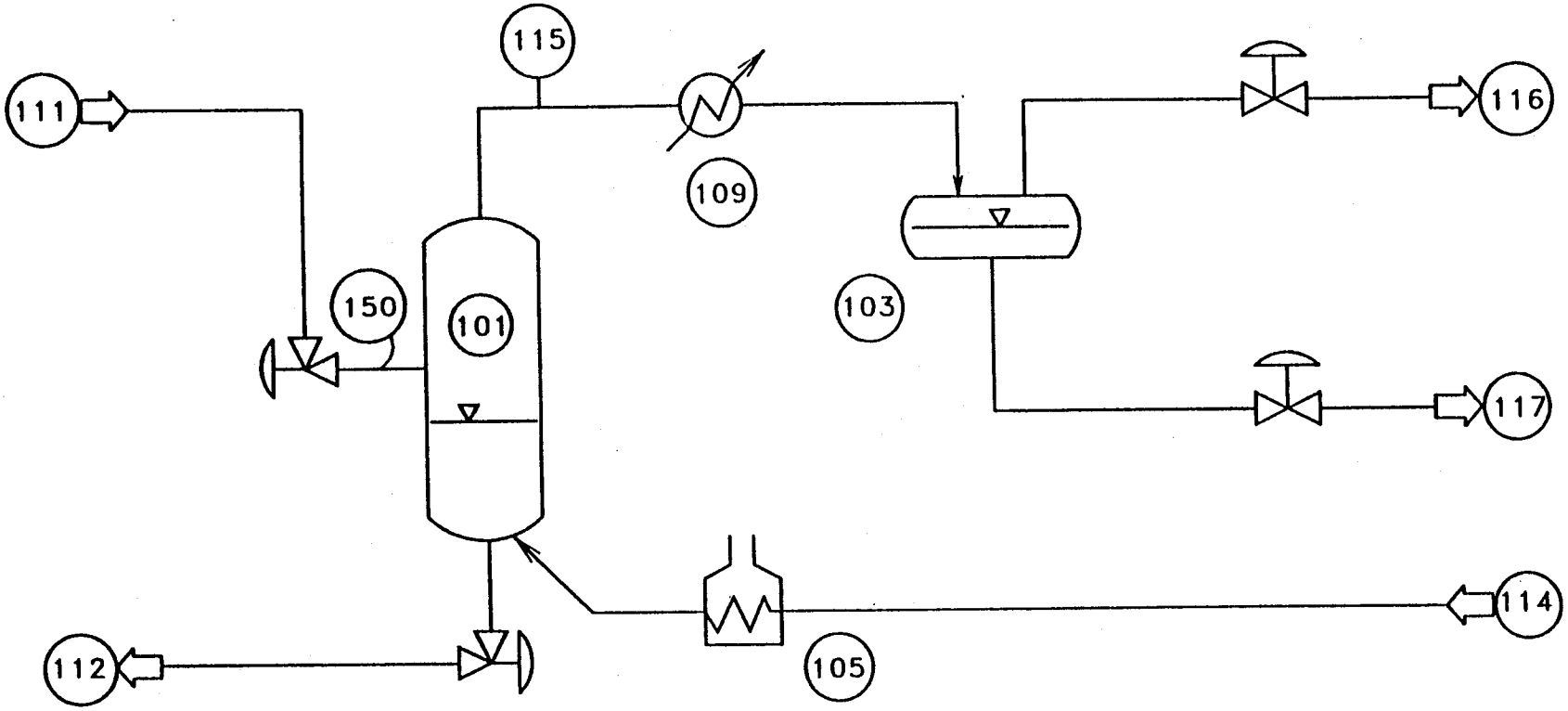
FIG. 2 is a schematic diagram of another process employing the present invention.

In a test conducted in a hydrogenation plant, the residue is treated by the stripper plant illustrated in FIG. 2.

Hydrogenation residue 111, the residue from conduit 11 of FIG. 1, which is at approximately 420° C. and is a solid asphalt mixture in which approximately 40% of the oil which boils at less than 500° C., is conducted through valved conduit 150 and depressurized from 40 bar to 10 bar in vessel 101.

Depressurization gas from conduit 114, which is rich in hydrogen, is formed in a previous process, heated in furnace 105 to about 450° C. and transported to the bottom of depressurization vessel 101.

The depressurization gas travels with the stripped oil from the top of vessel 101 through conduit 115 and is cooled in cooler 109 to about 30° C. The stripped oil, thereby, condenses. The oil is then separated from the depressurization gas in vessel 103. The oil is then transported through valved conduit 117, while the gas is transported through valved conduit 116.

The level of the residue is controlled. The residue is transferred outward from vessel 101 through valved conduit 112. The residue quality is adjusted by raising or lowering the depressurization gas temperature behind the furnace.

The following Tables, 1 and 2, show the product quality and the residue quality, in comparison, for the operation of a vacuum column and a stripper plant.

TABLE 1

Comparison of the boiling points of the product oils

| Vol. % | Vacuum Flash Temperature °C. | Stripper Condensate Temperature °C. |
|---|---|---|
| 0 | 212 | 193 |
| 10 | 242 | 261 |
| 20 | 256 | 285 |
| 30 | 270 | 302 |
| 40 | 289 | 316 |
| 50 | 291 | 333 |
| 60 | 299 | 350 |
| 70 | 314 | 365 |
| 80 | 333 | 385 |
| 90 | 356 | 417 |
| 100 | 435 | 504 |
| Density (kg/m$^3$) | 968 | 1,009 |
| Solids content (wt. %) | 0.03 | 0.02 |

TABLE 2

Comparison of residue qualities

| | | Vacuum Column | Stripping |
|---|---|---|---|
| Viscosity | (Pa s) | 0.62 | 0.522 |
| Liquid limit | (Pa) | 16 | 27 |
| Ash | (wt. %) | 13 | 21 |
| Softening point | (°C.) | 159 | 160 |
| Solids | (wt. %) | 44 | 43 |
| Solids and asphaltene | (wt. %) | 56 | 55 |

The results show that, under the test conditions, equivalent product and residue qualities can be produced.

Figure 3:
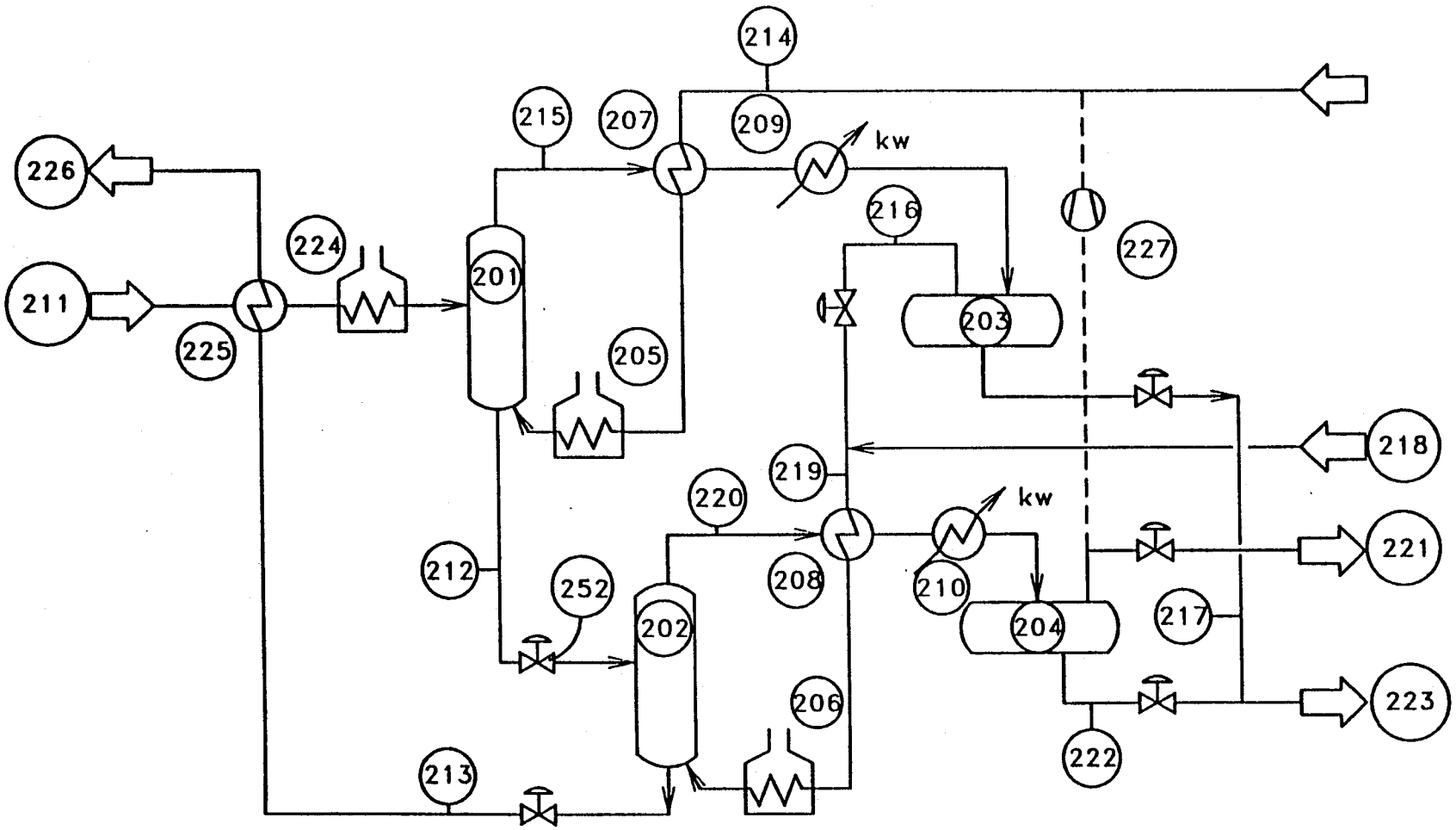
FIG. 3 is a schematic diagram of still another process employing the present invention.

FIG. 3 shows an example of a Process Plant which is a combination of the apparatus as shown in FIGS. 1 and 2. A residue stripping plant for a production process would operate in one or more stages with thermal recovery. For purposes of illustration, a two-stage stripper plant is described and illustrated in FIG. 3.

Hydrocarbon substances from conduit 211, to be separated, travels through heat exchanger 225, in counterflow to the separated residue in conduit 226 and then to furnace 224 and into first stripper vessel 201. In this case, stripper gas from conduit 214, is then heated in heat exchanger 207 and conducted through furnace 205 and conducted into the bottom of vessel 201.

The stripper gas, is enriched with oil and exits the top of vessel 201 via conduit 215. It is then cooled in heat exchanger 207 and cooler 209, until the oil condenses, and then transported to vessel 203. The level of the condensate removed and transported through valved conduit 217, is controlled and the condensate in conduit 217 is removed. The remaining stripper gas is conducted through valved conduit 216 and enters the second stage of processing under a controlled pressure.

The partly de-oiled residue from vessel 201 is conducted through conduit 212 and travels through a level control valve 252 into second stripper vessel 202. The stripper gas from the first stage is returned through a heat exchanger 208 and furnace 206 into the bottom of stripper vessel 202. If necessary, other process gases from conduit 218 can also be introduced here.

The stripper gas in conduit 220 contains oil and exits from the top of vessel 202. It is then cooled in heat exchanger 208 and in cooler 210 until the oil condenses and is then transported to vessel 204. The level of this condensate is controlled, removed through valved conduit 222, and the condensate is mixed with the oil from the first stage from conduit 217, and exits the plant as product in conduit 223. The de-oiled residue is conducted through valved conduit 213 and is cooled in heat exchanger 225.

If process gases are available in sufficient quantities, for stripping substances from conduits 214 and 218, the stripping gas is transferred outward from condensate vessel 204 and pressure regulated gas is conducted through conduit 221 for gas separation. Also, compressor 227 could be used to transport the gas back to the first stripper stage. The plant is, therefore, operated as a loop process. Therefore, only the stripper gas losses in conduit 214 need to be compensated.

In summary, one feature of the invention resides broadly in a process for the hydrogenation of coal, heavy crude oil, bitumen or similar substances at temperatures between 250° C. and 550° C., preferably between 380° C. and 480° C., and pressures between 50 bar and 700 bar, preferably between 100 bar and 325 bar, with precipitation of the hot sludge, in particular at temperatures below the hydrogenation temperature, whereby the hot sludge is stripped with gas, characterized by the fact that the required partial pressure change of the vapors to separate the products is produced by the gas used.

Another feature of the invention resides broadly in a process, characterized by the fact that the heat of vaporization is furnished with the input temperature of the fluid and/or with the input temperature of the gas.

Yet another feature of the invention resides broadly in a process characterized by the fact that a temperature between 250° C. and 600° C. and/or a pressure of about 1 bar to 150 bar prevails in the stripper vessel.

All, or substantially all, of the components and methods of the various embodiments may be used with at least one embodiment or all of the embodiments, if any, described herein.

All of the patents, patent applications, and publications recited herein, if any, are hereby incorporated by reference as if set forth in their entirety herein.

The invention as described hereinabove in the context of a preferred embodiment is not to be taken as limited to all of the provided details thereof, since modifications and variations thereof may be made without departing from the spirit and scope of the invention.

What is claimed is:

1. A method of processing hydrocarbon substances using a compressed gas containing from about 20% to about 100% hydrogen, said method comprising the steps of:

hydrogenating said hydrocarbon substance in a hydrogenating apparatus to obtain a product and a residue, said hydrogenating being performed at a first temperature range between about 250° C. and 600° C. and a first pressure range between about 50 bar and 700 bar, conducting compressed gas containing hydrogen to a heater to heat the compressed gas;

conducting the residue from the hydrogenating apparatus to a stripping vessel;

conducting the heated compressed gas from the heater to the stripping vessel;

pressurizing the stripping vessel to a second pressure range between about 1.2 bar and 150 bar, said second pressure range being lower than said first pressure range;

passing the heated compressed gas from the heater through the residue in said stripping vessel;

vaporizing at least a portion of the residue to form a vapor of at least one component of the residue;

forming in the stripping vessel a compressed gas mixture of the vapor of the at least one component of the residue and the compressed gas from the heater;

discharging the compressed gas mixture from the stripping vessel under hyperbaric pressure thereby stripping the at least one component of the residue from the residue to obtain a stripped residue;

conducting the compressed gas mixture from the stripping vessel to a separator;

separating the at least one component of the residue from the compressed gas mixture in the separator to obtain the at least one component and a further compressed gas;

removing the separated at least one component of the residue and the further compressed gas from the separating means;

discharging the stripped residue from the stripping vessel under hyperbaric pressure; and varying the temperature of the compressed gas from the heater to adjust at least one characteristic of the stripped residue; the said at least one characteristic being selected from the group consisting of viscosity, liquid limit, ash, softening point, solids content, and solids and asphaltene content;

wherein the temperature of at least one of:

the stripped residue; and the heated compressed gas provides the heat of vaporization for the at least a portion of the at least one component of the residue in the stripping vessel; and said stripping of the at least one component of the residue from the residue occurs by a partial pressure change of the vapor of the at least one component as a result of said combining the vapor of the at least one component with the compressed gas to form the compressed gas mixture and thereafter conducting the compressed gas mixture from the stripping vessel.

2. The method of claim 1, wherein said separating the at least one component of the residue from the compressed gas mixture in the separator to obtain the at least one component and the compressed gas comprises:

conducting the compressed gas mixture to a condenser;

cooling the compressed gas mixture to condense the at least one component of the residue out of the compressed gas mixture into a condensate while leaving the compressed gas in a gaseous state;

conducting the compressed gas and the at least one component of the residue into a separator vessel, said separator vessel having a top and a bottom;

removing the compressed gas from the top of the separator vessel; and removing the at least one component of the residue from the bottom of the separator vessel.

3. The method of claim 2, wherein said varying the temperature of the compressed gas from the heater comprises varying the temperature within a range of about 193° C. to about 504° C. to produce condensate having a boiling temperature within said range.

4. The method of claim 3, wherein said adjusting at least one characteristic of the stripped residue provides a stripped residue which has a viscosity of about 0.522 Pa s, a liquid limit of about 27 Pa, an ash content of about 21 wt. %, a softening point of about 160° C., a solids content of about 43 wt. %, and a solids and asphaltene content of about 55 wt. %.

5. The method of claim 4, wherein said processing a hydrocarbon substance comprises processing at least one of: coal, heavy crude oil, and bitumen.

* * * * *